US011173711B2

(12) United States Patent
Anderson et al.

(10) Patent No.: US 11,173,711 B2
(45) Date of Patent: Nov. 16, 2021

(54) FLUIDIC DIE REGULATION MODULES

(71) Applicant: Hewlett-Packard Development Company, L.P., Spring, TX (US)

(72) Inventors: Daryl E. Anderson, Corvallis, OR (US); Eric Martin, Corvallis, OR (US); James Michael Gardner, Corvallis, OR (US)

(73) Assignee: Hewlett-Packard Development Company, L.P., Spring, TX (US)

( * ) Notice: Subject to any disclaimer, the term of this patent is extended or adjusted under 35 U.S.C. 154(b) by 0 days.

(21) Appl. No.: 16/762,956

(22) PCT Filed: Nov. 22, 2017

(86) PCT No.: PCT/US2017/063039

§ 371 (c)(1),
(2) Date: May 11, 2020

(87) PCT Pub. No.: WO2019/103739

PCT Pub. Date: May 31, 2019

(65) Prior Publication Data

US 2020/0398561 A1 Dec. 24, 2020

(51) Int. Cl.
*B41J 2/045* (2006.01)

(52) U.S. Cl.
CPC ..... *B41J 2/04591* (2013.01); *B41J 2/0458* (2013.01); *B41J 2/04563* (2013.01); *B41J 2/04581* (2013.01)

(58) Field of Classification Search
CPC .. B41J 2/04591; B41J 2/04563; B41J 2/0458; B41J 2/04581; B41J 2/03; B41J 2/04531; B41J 2/04538; B41J 2/0454; B41J 2/04553; B41J 2/04565; B41J 2/055; B41J 2/1408; B41J 2/17556; B41J 29/377; B41J 2002/14354; B41J 2202/08
See application file for complete search history.

(56) References Cited

U.S. PATENT DOCUMENTS

| | | | |
|---|---|---|---|
| 5,107,276 | A | 4/1992 | Kneezel et al. |
| 6,302,507 | B1 | 10/2001 | Prakash et al. |
| 6,390,580 | B1 | 5/2002 | Anderson et al. |
| 2010/0097114 | A1 | 4/2010 | Miyazaki et al. |
| 2010/0207977 | A1 | 8/2010 | Sliverbrook et al. |
| 2011/0187777 | A1 | 8/2011 | Shin et al. |
| 2011/0279503 | A1 | 11/2011 | Mizes et al. |
| 2016/0067963 | A1 | 3/2016 | van Brocklin et al. |

OTHER PUBLICATIONS

Alaman, J. et al., Inkjet Printing of Functional Materials for Optical and Photonic Applications, Nov. 10, 2016, https://www.ncbi.nlm.nih.gov/pmc/articles/PMC5457235/.

*Primary Examiner* — Kristal Feggins
(74) *Attorney, Agent, or Firm* — Fabian VanCott

(57) ABSTRACT

A fluidic die that may, in an example, include a regulation module communicatively coupled to a clock generator to receive a clock signal, and a firing pulse adjustment regulator communicatively coupled to the regulation module to receive an adjustment value wherein the regulation module, when executed by a processor, adjusts an input firing pulse at the fluidic die based on the adjustment value.

20 Claims, 9 Drawing Sheets

FLUIDIC DIE REGULATION MODULES

BACKGROUND

Printing devices include fluid ejection devices such as a number of fluidic die that eject an amount of fluid onto a surface of a print media. The fluid is ejected from the fluidic die using an actuation device such as a resistive heating element or a piezoelectric device.

DETAILED DESCRIPTION

Figure 1:
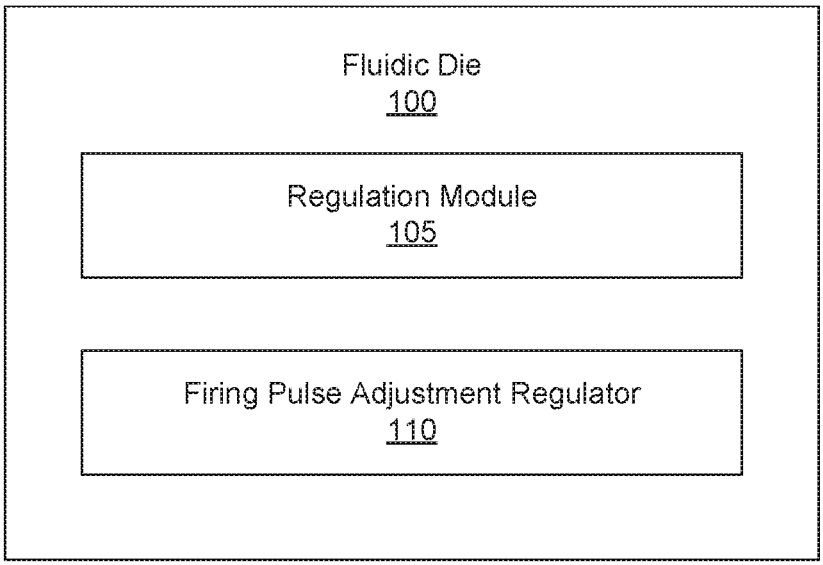
FIG. 1 is a block diagram of a fluidic die according to an example of the principles described herein.

Some printing devices may include fluid ejection devices such as a fluidic die. The fluidic die may be any type of fluidic die and may, in some examples, be coupled to the surface of a print bar, print cartridge, or other type of fluid ejection device. The fluidic die is electrically coupled to a power source that provides power to an actuator such as a heating element or piezoelectric device that has been placed within a firing chamber defined within the fluidic die. As the actuator receives power from the power source, it causes an amount of fluid to be ejected from the fluidic die through an orifice formed in the fluidic die.

The power source may provide power to the actuator in the form of a firing pulse. A fire pulse provides an indication to the fluidic die to fire or release a drop of fluid onto, for example, a print medium. The sending of the firing pulse results in energy being applied to, for example, a heating element to effectuate the firing of the drop of fluid. In this example, energy from a fire pulse activates the heating element to generate heat, which causes a drive bubble to form within a firing chamber. As the drive bubble expands, it forces the drop of fluid out of the firing chamber and through an orifice defined in the fluidic die. Once the drop of fluid is ejected, the drive bubble collapses and the volume of fluid ejected is replenished within the firing chamber by a fluid reservoir in preparation for subsequent firing.

During operation of the fluidic die, however, the fluidic die may heat up. This heat may be the result of the firing of the actuation device, the temperature of the environment the fluidic die is operating in, or other mechanical devices operating within or near the die. In these examples, as the temperature changes and, more specifically, as the heat increases, the fluid ejection characteristics of the fluidic die may also change as well as the viscosity of the fluid being ejected. As a result, the quality of print rendered by the fluid ejection device may change based on the temperature experienced by the fluidic die. Temperature sensors may be provided to monitor the changes in temperature. However, this monitoring may not prevent the fluidic die from ejecting inconsistent drop weights of fluid, inconsistent velocities of fluid ejected, inconsistent shapes of the fluid ejected, and inconsistent conglomeration of the fluid during ejection.

The present specification describes a fluidic die that includes a regulation module communicatively coupled to a clock generator to receive a clock signal, and a firing pulse adjustment regulator communicatively coupled to the regulation module to receive an adjustment value wherein the regulation module adjusts an input firing pulse at the fluidic die based on the adjustment value.

The present specification also describes a method of firing a fluidic die that includes generating a clock signal with a clock generator, receiving, at a regulation module, the generated clock signal and a firing signal, and adjusting the firing signal at the fluidic die based on an input adjustment value.

The present specification further describes A computer program product for firing a fluidic die, the computer program product that includes a computer readable storage medium including computer usable program code embodied therewith, the computer usable program code to, when executed by a processor generate a clock signal with a clock generator and cause the generated clock signal and a firing signal to be received at the regulation module. The regulation module may then and adjust the firing signal at the fluidic die based on an input adjustment value.

FIG. 1 is a block diagram of a fluidic die (100) according to an example of the principles described herein. The fluidic die (100) may include a regulation module (105) and a firing pulse adjustment regulator (110).

The fluidic die (100) may be any die that receives an amount of fluid and, implementing an actuator, ejects an amount of fluid out of the fluidic die (100). The fluidic die (100) may include any number and/or type of actuators. Examples of actuators may include a thermal resistor ejection element, a piezoelectric ejection element or any other type of actuation device that may eject, from the die, an amount of fluid. Each of the actuators may be placed within a fluid chamber with a paired orifice through which the fluid may be ejected.

In an example, the fluidic die (100) may be partitioned into a number of zones. The zones may include any number of actuators each paired with at least one orifice. In an example, a zone may include a single actuator including its paired orifices. In an example, a zone may include a plurality of ejection devices with their respectively paired orifices. In an example, a zone includes all of the actuators and their respectively paired orifices.

In an example, each zone may include its own pair of regulation module (105) and firing pulse adjustment regulator (110). In an example, each zone may include its own regulation module (105) with a firing pulse adjustment regulator (110) being provided for all zones on the fluidic die (100).

In an example, in addition to the regulation module (105) and firing pulse adjustment regulator (110), the fluidic die (100) and/or each zone of the fluidic die (100) may include a temperature sensor to sense the temperature of the fluidic die (100) and/or zone of the fluidic die (100). The temperature sensed by the temperature sensor may be used to determine if and/or to what extent a firing pulse is to be reduced or extended.

The fluidic die (100) and/or the zones of the fluidic die (100) are to be fired at a specified temperature based on a plurality of characteristics of the fluidic die (100) and/or the fluid ejected from the die. As mentioned herein, the temperature of the fluidic die (100) and/or the zones of the fluidic die (100) may be below or above the specified temperature. Where the temperature of the fluidic die (100) and/or the zones of the fluidic die (100) are below the specified temperature, the firing pulse may be adjusted by the regulation module (105) such that the firing pulse is extended. In an example, the regulation module (105) may be any logic, executable program code, hardware device, or combinations thereof that helps to adjust a firing pulse. Where the temperature of the fluidic die (100) and/or the zones of the fluidic die (100) are above the specified temperature, the firing pulse may be adjusted by the regulation module (105) such that the firing pulse is trimmed. In this way, the regulation module (105), with the adjustment value calculated and received by the firing pulse adjustment regulator (110), may regulate the temperature of the fluidic die (100) by increasing or decreasing the temperature via extension or trimming, respectively, of the firing pulse. In specific examples, the firing pulse may be regulated as a function of the temperature of at least one zone of the fluidic die (100).

In an example, the firing pulse adjustment regulator (110) may receive a temperature value sensed by a temperature sensor. Based on the value received by the temperature sensor, the look-up table (LUT) may be used to send an adjustment value to the firing pulse adjustment regulator (110). The LUT is used to determine if and to what degree the firing pulse should be adjusted based on the sensed temperature of the zone. In other examples, how the firing pulse is to be adjusted based on the received temperature value is calculated before the adjustment value is sent to the firing pulse adjustment regulator (110).

In an example, the length of the firing pulse (315) is metered based on a received clock signal. In an example, the firing pulse may be altered by the received clock signal provided by a timing clock. The modulation of the firing pulse, therefore, modulates the energy delivered to an actuator in the fluidic die (100).

In a situation where the temperature of any one of the zones of the die are at a predetermined optimal temperature and, accordingly, the firing pulse is not to be adjusted, the clock may meter out the firing pulse to, for example, 8 cycles. The regulation module (105) may receive the firing pulse with the clock signal. The firing pulse adjustment regulator (110), based on the temperature of the zones, sends an adjustment value to the regulation module (105). The regulation module (105) then adjusts the firing value as described herein.

During operation of the fluidic die (100), the firing pulse adjustment regulator (110) may be loaded with an adjustment value. The adjustment value may be determined by a global adjustment register that has received the temperature of, at least, the zone where the regulation module (105) and firing pulse adjustment regulator (110) are located. In an example, the global adjustment register implements a look-up table (LUT) to determine to what degree a firing pulse to the zone is to be adjusted based on the temperature of that zone. Having determined that adjustment value, the global adjustment register may send that adjustment value to the firing pulse adjustment regulator (110) at the zone.

A firing pulse may then be sent to the zone. In an example, the pulse is metered out to have a firing length of a certain amount regardless of the adjustment to be made. The firing pulse along with the adjustment value from the firing pulse adjustment regulator (110) is loaded into the regulation module (105). When the firing pulse is received by the regulation module (105), the regulation module (105) begins counting a number of clock values based on the adjustment value received. In an example, the regulation module (105) is assisted by a timing clock that provides a clock signal to the regulation module (105) in order for the regulation module (105) to adjust the transmission of the firing pulse at a logic gate. In the example where the firing pulse is to be trimmed, an output from the regulation module (105) inhibits the progression of a leading edge of the pulse by implementing a digital logic function via hardware such as an AND gate. The pulse from the regulation module (105) may be a negative pulse. When the counter is finished counting down the adjustment value, the firing pulse is allowed to pass out of the AND gate and proceed to an actuator within a fluid chamber formed within the fluidic die (100).

In an example, the firing pulse may be extended. In this example, the zone on the fluidic die (100) may, at the firing pulse adjustment regulator (110), receive an adjustment value that is used by the regulation module (105) to increase the number of counts used to extend the firing pulse. Output from the regulation module (105) may have a digital logic function applied to the output via hardware such as an OR gate with the firing pulse such that the firing pulse is allowed to pass through to the OR gate and to an actuator. At the trailing edge of the firing pulse, however, the regulation module (105) may cause extra counts to be added to the firing pulse such that the firing pulse continues to be sent to the actuator. The regulation module (105) may send a positive pulse to the OR gate in order to extend the firing signal.

In an example, the zone may include a regulation module (105) and a firing pulse adjustment regulator (110) as described herein and may implement logical functions via hardware such as the two logic gates described herein. The zone may also include a multiplexer. The example logic gates may include an AND and an OR gate. In this example, an inverter (NOT gate) may be used to output a signal that is opposite of the output of the regulation module (105). In this example, the inverter may be placed between the regulation module (105) and the AND gate, Where the output of the regulation module (105) is negative, the signal is sent to an AND gate due to the active high signal originating from the regulation module (105). Where the output of the regulation module (105) is positive, the signal is sent to an OR gate. A multiplexer is placed after the OR and AND gate to receive a signal from either of the OR or AND gate and pass the firing pulse onto the actuators accordingly.

In an example, the regulation module (105) may be a shift register. The shift register may, instead of receiving a trim value, may receive a number of bits. The bits are shifted out on a least significant bit first manner. A negative pulse may be output to an AND gate. Each "0" within the bits presented to the regulation module (105) by the firing pulse adjustment regulator (110) represent a suppression of the firing pulse while a "1" allows the firing pulse to be active. The presently described shift register may also be used to extend the duration of the firing pulse in a similar manner. As a result, any amount of time within any portion of the firing pulse may be suppressed. However, in examples where the firing pulse is to be trimmed or extended by a relatively large amount such as by 64 counts of the clock, the size of the resulting shift register may take up a significant portion of the fluidic die (100). In this case, a counter may be added instead.

Figure 2:
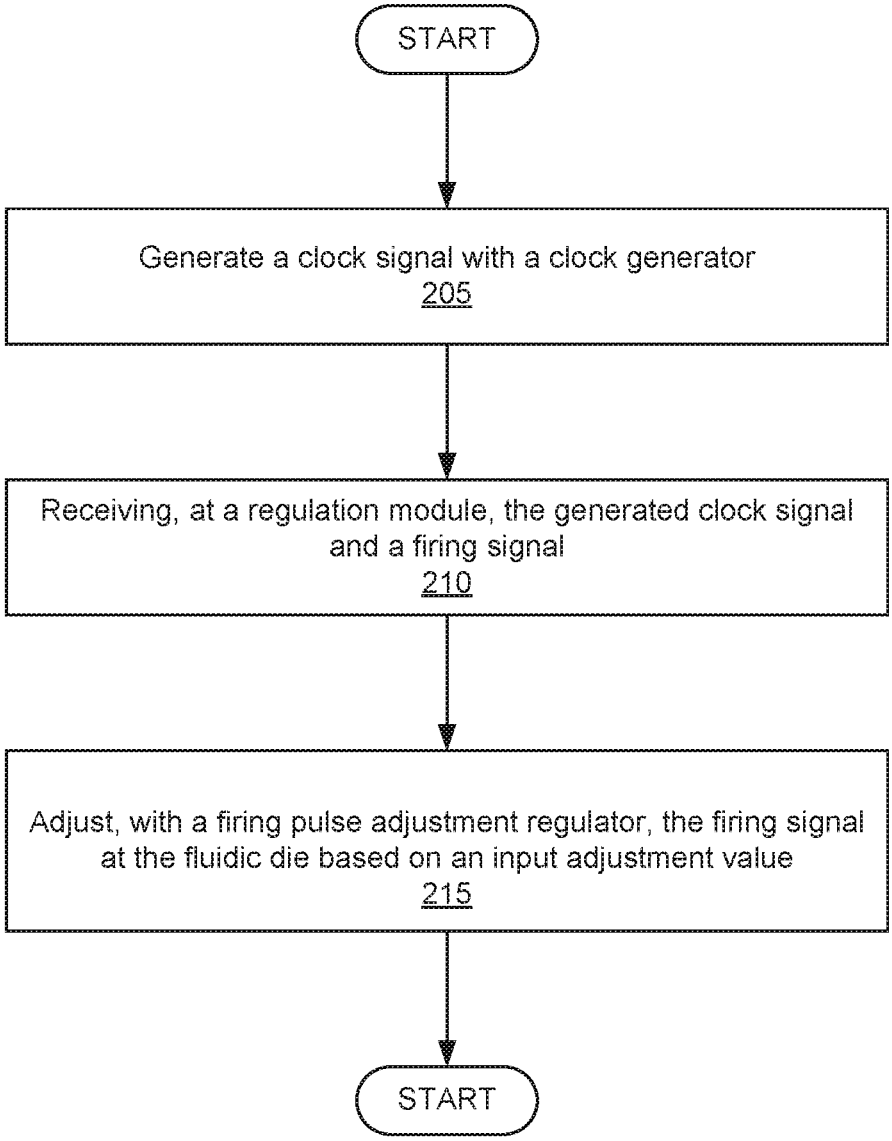
FIG. 2 is a flowchart showing a method of firing a fluidic die according to an example of the principles described herein.

FIG. 2 is a flowchart showing a method (200) of firing a fluidic die according to an example of the principles described herein. The method (200) may begin with generating (205) a clock signal with a clock generator. As described herein, the clock signal is used to meter the cycles the firing pulse is to span as well as determine to what extent the firing pulse is to be adjusted.

The method (200) may continue with receiving (210), at a regulation module (FIG. 1, 105), the generated clock signal and a firing signal. The firing signal, as described herein, may be provided to the zone and may have a predetermined length although the regulation module (105) may direct the firing pulse to be trimmed or extended.

The method (200) may continue with adjusting (215), with a firing pulse adjustment regulator (FIG. 1, 110), the firing signal at the fluidic die based on an input adjustment value. As described herein the adjustment value may be based on the temperature of the fluidic die (FIG. 1, 100) or zones within the fluidic die (FIG. 1, 100). The adjustment value may be received by the firing pulse adjustment regulator (FIG. 1, 110) from, in an example, a global adjustment register. In an example, the adjustment value is in the form of an adjustment value sent to a counter to count the value and suppress the firing signal at an AND gate until the count is completed. In an example, the adjustment value is in the form of an adjustment value sent to a counter to count the value and extend the firing signal at an OR gate until the count is completed.

The fluidic die (100) may form, at least part, of a print device. In an example, the fluidic die (100) may be one of a number of fluidic dies coupled to, for example, a printing fluid cartridge or a page wide array of fluidic dies (100). The fluidic die (100) may be controlled using a processor of a printing device. In an example, at least the global adjustment register may be controlled by the processor of the printing device. The printing device may be a stand-alone device or may be further provided, at least, print data from an electronic device such as a computing device. Examples of computing devices include servers, desktop computers, laptop computers, personal digital assistants (PDAs), mobile devices, smartphones, gaming systems, and tablets, among other electronic devices.

The printing device may be utilized in any data processing scenario including, stand-alone hardware, mobile applications, through a computing network, or combinations thereof. Further, the printing device may be used in a computing network, a public cloud network, a private cloud network, a hybrid cloud network, other forms of networks, or combinations thereof. In one example, the methods provided by the printing device are provided as a service over a network by, for example, a third party.

To achieve its desired functionality, the printing device may include various hardware components. Among these hardware components may be a number of processors, a number of data storage devices, a number of peripheral device adapters, and a number of network adapters. These hardware components may be interconnected through the use of a number of busses and/or network connections. In one example, the processor, data storage device, peripheral device adapters, and a network adapter may be communicatively coupled via a bus.

The processor may include the hardware architecture to retrieve executable code from the data storage device and execute the executable code. The executable code may, when executed by the processor, cause the processor to implement at least the functionality of generating a clock signal with a clock generator, receiving, at a regulation module, the generated clock signal and a firing signal, and adjust, with a regulation module, the firing signal at the fluidic die based on an input adjustment value according to the methods of the present specification described herein. In the course of executing code, the processor may receive input from and provide output to a number of the remaining hardware units.

The data storage device may store data such as executable program code that is executed by the processor. As will be discussed, the data storage device may specifically store computer code representing a number of applications that the processor executes to implement at least the functionality described herein.

The data storage device may include various types of memory modules, including volatile and nonvolatile memory. For example, the data storage device of the present example includes Random Access Memory (RAM), Read Only Memory (ROM), and Hard Disk Drive (HDD) memory. Many other types of memory may also be utilized, and the present specification contemplates the use of many varying type(s) of memory in the data storage device as may suit a particular application of the principles described herein. In certain examples, different types of memory in the data storage device may be used for different data storage needs. For example, in certain examples the processor may boot from Read Only Memory (ROM), maintain nonvolatile storage in the Hard Disk Drive (HDD) memory, and execute program code stored in Random Access Memory (RAM). Generally, the data storage device may comprise a computer readable medium, a computer readable storage medium, or a non-transitory computer readable medium, among others. For example, the data storage device may be, but not limited to, an electronic, magnetic, optical, electromagnetic, infrared, or semiconductor system, apparatus, or device, or any suitable combination of the foregoing. More specific examples of the computer readable storage medium may include, for example, the following: an electrical connection having a number of wires, a portable computer diskette, a hard disk, a random-access memory (RAM), a read-only memory (ROM), an erasable programmable read-only memory (EPROM or Flash memory), a portable compact disc read-only memory (CD-ROM), an optical storage device, a magnetic storage device, or any suitable combination of the foregoing. In the context of this document, a computer readable storage medium may be any tangible medium that can contain, or store computer usable program code for use by or in connection with an instruction execution system, apparatus, or device. In another example, a computer readable storage medium may be any non-transitory medium that can contain, or store a program for use by or in connection with an instruction execution system, apparatus, or device.

Figure 3:
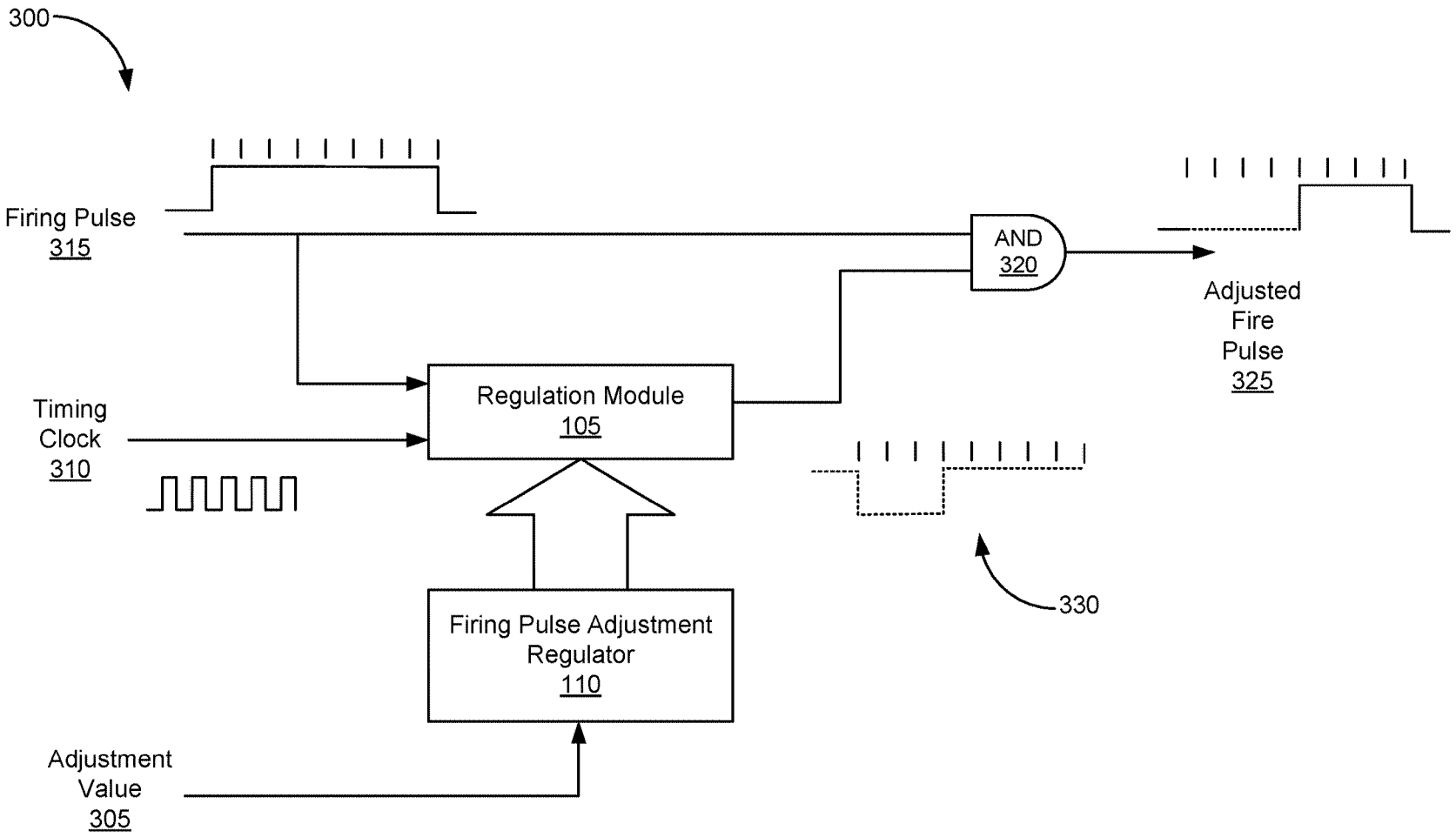
FIG. 3 is a circuit diagram formed on a zone of a fluidic die according to an example of the principles described herein.
Figure 4:
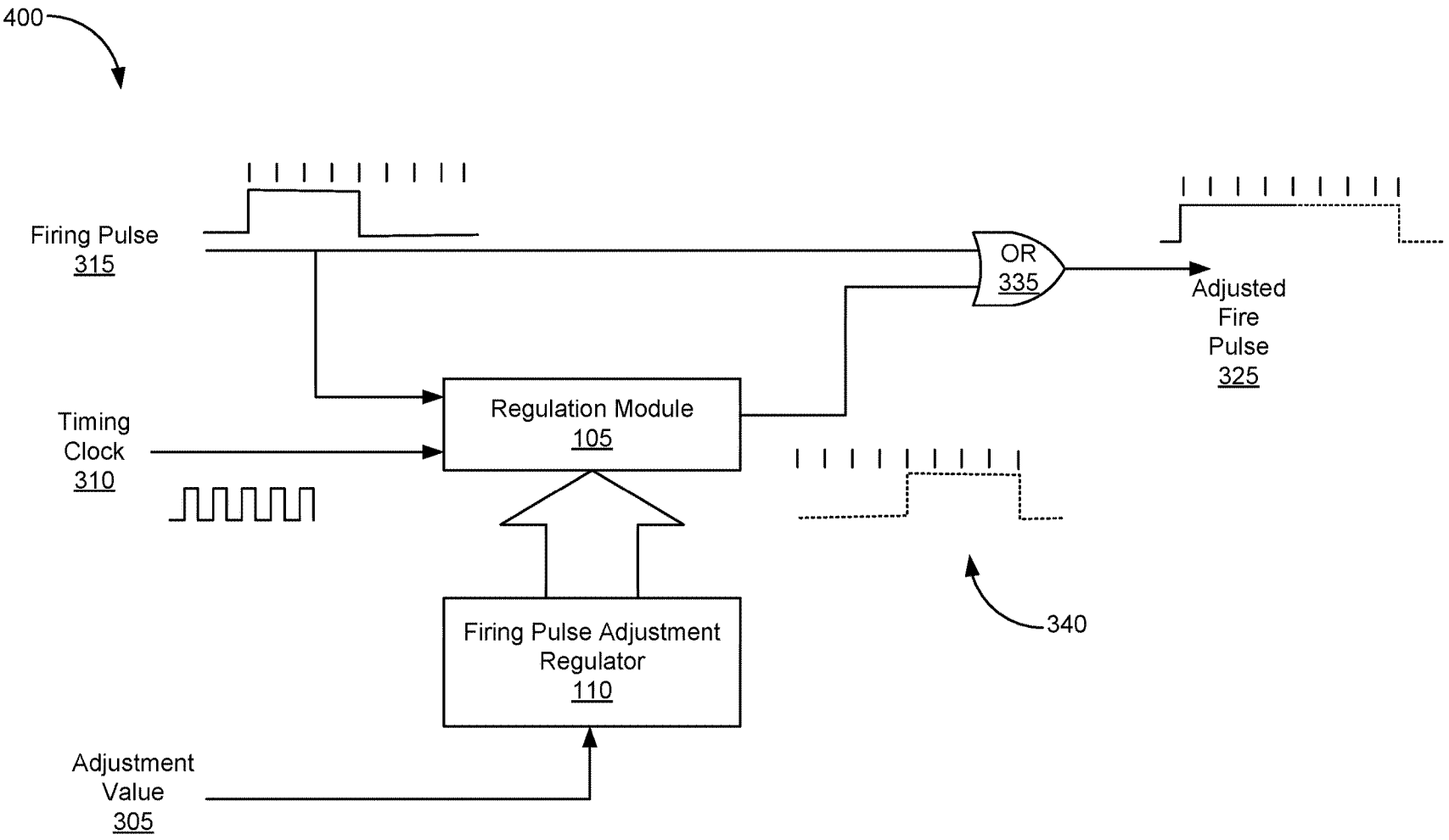
FIG. 4 is a circuit diagram formed on a zone of a fluidic die according to an example of the principles described herein.
Figure 5:
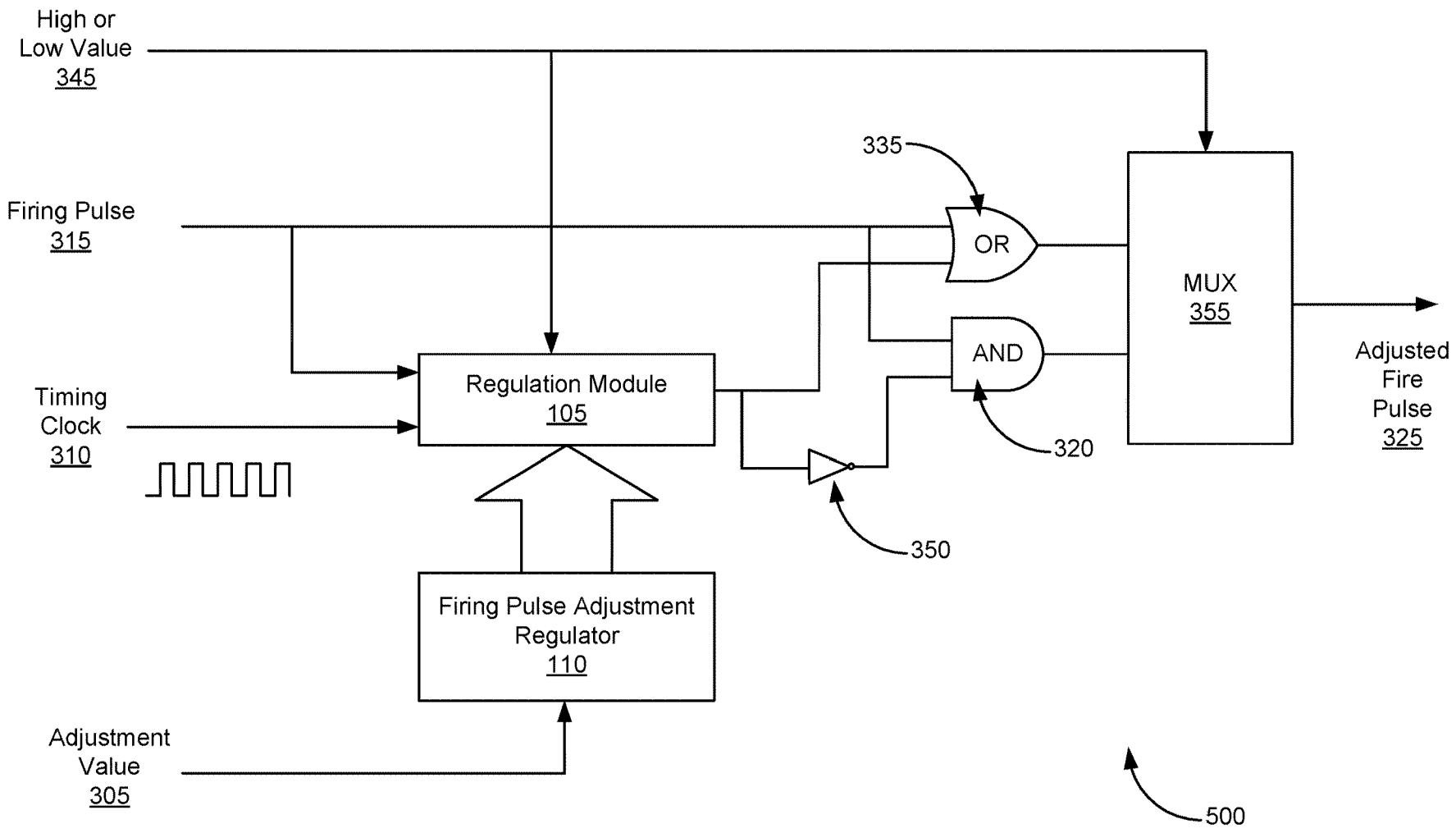
FIG. 5 is a circuit diagram formed on a zone of a fluidic die according to an example of the principles described herein.

FIGS. 3-5 show a number of examples of circuit diagrams that may be formed on the fluidic die (100) in order to adjust the firing signal sent to at least one zone defined on the fluidic die (100). FIG. 3 is a circuit diagram (300) formed on a zone of a fluidic die (FIG. 1, 100) according to an example of the principles described herein. As described herein, the circuit (300) may include a regulation module (FIG. 1, 105) and a firing pulse adjustment regulator (FIG. 1, 110). During operation, an adjustment value (305) may be communicated to the firing pulse adjustment regulator (FIG. 1, 110) from an adjustment register. In an example, each of the zones may receive a similar or different adjustment value (305). In the example shown in FIG. 3, the adjustment value is 3 meaning that for 3 clock cycles the regulation module (FIG. 1, 105) is to inhibit the firing of the firing pulse. Additionally, the regulation module (FIG. 1, 105) may receive a timing clock signal (310) and an unadjusted firing pulse (315). In the example shown in FIG. 3, the firing pulse (315) may be 8 clock cycles long.

The regulation module (FIG. 1, 105) may adjust the incoming firing pulse (315) and output a negative signal (330) to an AND gate (320). The signal inhibits the firing pulse (315) at the AND gate (320) until the regulation module (FIG. 1, 105) has accounted for the adjustment value (305). Specifically, the rising edge of the firing pulse, in this example, is inhibited by the output of the regulation module (FIG. 1, 105).

In the example where the regulation module (FIG. 1, 105) is a counter, the counter prevents the firing of the firing pulse (315) for 3 clock cycles according to the adjustment value (305) being 3 clock cycles. Where the regulation module (FIG. 1, 105) is a shift register, the shift register receives bit information from the firing pulse adjustment regulator (FIG. 1, 110) and, with the aid of the timing clock signal (310), inhibits the firing of the firing pulse (315) until the least significant bits are shifted out. An adjusted firing pulse (325) is then produced and allowed to move onto an actuator within the fluidic die (FIG. 1, 100). In either example, the leading edge of the original firing pulse (315) is not fired resulting in the adjusted firing pulse (325).

FIG. 4 is a circuit (400) diagram formed on a zone of a fluidic die (FIG. 1, 100) according to an example of the principles described herein. As described herein, the circuit (400) may include a regulation module (FIG. 1, 105) and a firing pulse adjustment regulator (FIG. 1, 110). During operation, an adjustment value (305) may be communicated to the firing pulse adjustment regulator (FIG. 1, 110) from an adjustment register. In the example shown in FIG. 4, the adjustment value is 4 meaning that for 4 clock cycles the regulation module (FIG. 1, 105) allows the firing of the firing pulse. Additionally, the regulation module (FIG. 1, 105) may receive a timing clock signal (310) and an unadjusted firing pulse (315). In the example shown in FIG. 4, the firing pulse (315) may be 8 clock cycles long.

The regulation module (FIG. 1, 105) may adjust the incoming firing pulse (315) and output a positive signal (340) to an OR gate (335). The signal extends the firing pulse (315) at the OR gate (320) until the regulation module (FIG. 1, 105) has accounted for the adjustment value (305). In this example, the falling edge of the firing pulse (315) may be extended using the adjustment value (305) as described.

In the example where the regulation module (FIG. 1, 105) is a counter, the counter prevents the firing of the firing pulse (315) for 3 clock cycles according to the adjustment value (305) being 3 clock cycles. Where the regulation module (FIG. 1, 105) is a shift register, the shift register receives bit information from the firing pulse adjustment regulator (FIG. 1, 110) and, with the aid of the timing clock signal (310), inhibits the firing of the firing pulse (315) based on the masking (i.e., "0") and non-masking (i.e., "1") values of the bits. An adjusted firing pulse (325) is then produced and allowed to move onto an actuator within the fluidic die (FIG. 1, 100). In either example, the leading edge of the original firing pulse (315) is not fired resulting in the adjusted firing pulse (325).

FIG. 5 is a circuit (500) diagram formed on a zone of a fluidic die according to an example of the principles described herein. FIG. 5 as shown may be considered a hybrid of the circuits shown in FIGS. 3 and 4. In this example, the regulation module (FIG. 1, 105) receives the adjustment value (305) from the firing pulse adjustment regulator (FIG. 1, 110) (received from the adjustment register, the timing clock signal (310), and the firing pulse (315). Additionally, the regulation module (FIG. 1, 105) may receive a high or low signal (345). The high or low signal (345) may indicate to the regulation module (FIG. 1, 105) whether to start the augmentation of the firing pulse (315) at the rising edge of the firing pulse (315) or the falling edge of the firing pulse (315). In an example, this will match the whether the pulse is to be trimmed or extended respectively. The circuit (500) may further include both an AND gate (320) and an OR gate (335). A signal from the regulation module (FIG. 1, 105) may be sent to the AND gate (320) and the OR gate (335). In an example, the AND gate (320) includes a NOT gate (350) that inverts the input from the regulation module (FIG. 1, 105) before it is sent to the AND gate (320). In this example, a multiplexer (355) may receive the output from either the AND gate (320) or the OR gate (335) and send the adjusted firing pulse (325) to the actuator as described herein.

Figure 6:
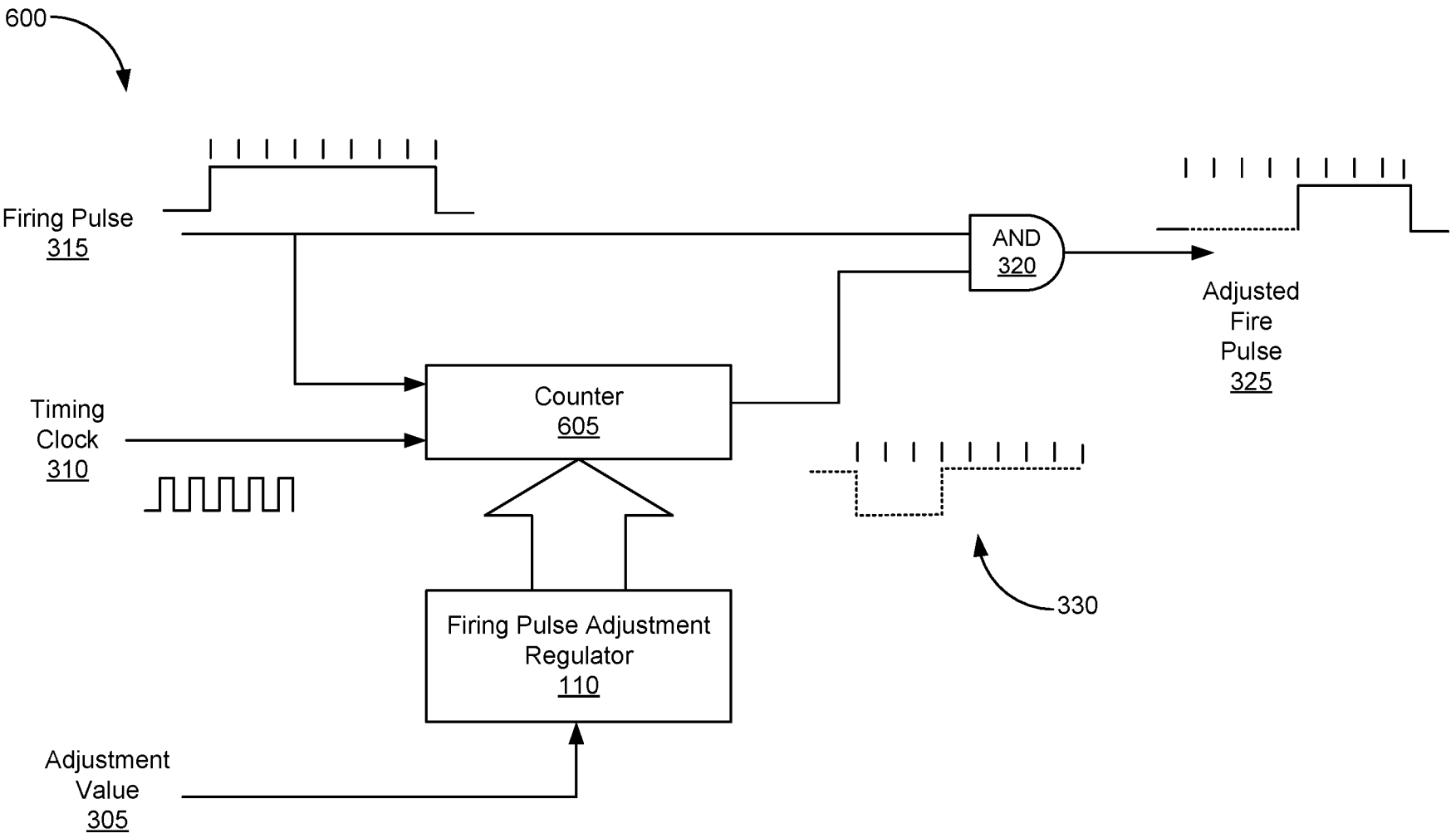
FIG. 6 is a circuit diagram formed on a zone of a fluidic die according to an example of the principles described herein.

FIG. 6 is a circuit diagram formed on a zone of a fluidic die according to an example of the principles described herein. Similar to FIG. 3, the circuit (600) of FIG. 6 may include a firing pulse adjustment regulator (FIG. 1, 110) and a logic gate such as the AND gate (320) depicted. In this example, the circuit (600) may further include a counter (605) as described herein. During operation of the fluidic die (FIG. 1, 100), the firing pulse adjustment regulator (110) may be loaded with an adjustment value. The adjustment value may be determined by a global adjustment register that has received the temperature of, at least, the zone that the counter (605) and firing pulse adjustment regulator (110) are located. In an example, the global adjustment register implements a look-up table (LUT) to determine to what degree a firing pulse to the zone is to be adjusted based on the temperature of that zone. Having determined that adjustment value, the global adjustment register may send that adjustment value to the firing pulse adjustment regulator (110) at the zone.

A firing pulse may then be sent to the zone. In an example, the pulse is metered out to have a firing length of a certain amount regardless of the adjustment to be made. The firing pulse along with the adjustment value from the firing pulse adjustment regulator (110) is loaded into the counter (605). When the firing pulse is received by the counter (605), the counter (605) begins counting a number of clock values based on the adjustment value received. In an example, the counter (605) is assisted by a timing clock that provides a clock signal to the counter (605) in order for the regulation module (105) to adjust the transmission of the firing pulse at a logic gate. In the example where the firing pulse is to be trimmed, an output from the counter (605) inhibits the progression of a leading edge of the pulse by implementing a digital logic function via hardware such as an AND gate (325). The pulse from the counter (605) may be a negative pulse. When the counter (605) is finished counting down the adjustment value, the firing pulse is allowed to pass out of the AND gate (320) and proceed to an actuator within a fluid chamber formed within the fluidic die (FIG. 1, 100).

In an example, the firing pulse may be extended. In this example, the zone on the fluidic die (FIG. 1, 100) may, at the firing pulse adjustment regulator (110), receive an adjustment value that is used by the counter (605) to increase the number of counts used to extend the firing pulse. Output from the counter (605) may have a digital logic function applied to the output via hardware such as an OR gate with the firing pulse such that the firing pulse is allowed to pass through to the OR gate and to an actuator. At the trailing edge of the firing pulse, however, the counter (605) may cause extra counts to be added to the firing pulse such that the firing pulse continues to be sent to the actuator. The counter (605) may send a positive pulse to the OR gate in order to extend the firing signal.

The circuit (600) show in FIG. 6 is merely an example circuit arrangement. In some examples, additional circuitry may be included such as that shown in FIG. 5. In some examples, the circuit (600) shown in FIG. 6 may implement the regulation module and firing pulse adjustment regulator illustrated in FIG. 1.

Figure 7:
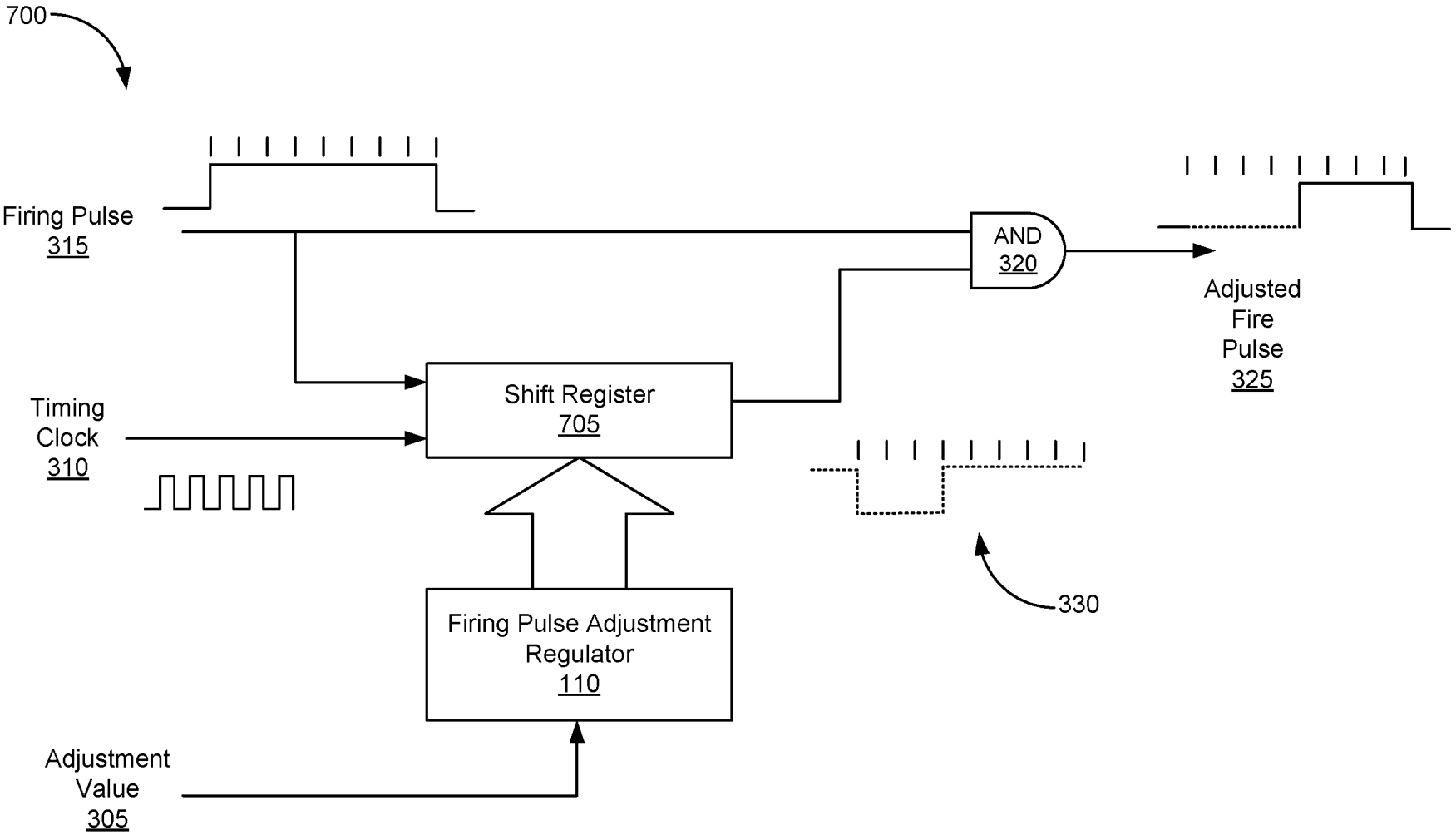
FIG. 7 is a circuit diagram formed on a zone of a fluidic die according to an example of the principles described herein.

FIG. 7 is a circuit diagram formed on a zone of a fluidic die according to an example of the principles described herein. Similar to FIG. 3, the circuit (600) of FIG. 6 may include a firing pulse adjustment regulator (FIG. 1, 110) and a logic gate such as the AND gate (320) depicted. In this example, the circuit (600) may further include a shift register (705) as described herein. The shift register (705) may, instead of receiving a trim value, may receive a number of bits. The bits are shifted out on a least significant bit first manner. A negative pulse may be output to an AND gate (325). Each "0" within the bits presented to the shift register (705) by the firing pulse adjustment regulator (FIG. 1, 110) represent a suppression of the firing pulse while a "1" allows the firing pulse to be active. The presently described shift register (705) may also be used to extend the duration of the firing pulse in a similar manner. As a result, any amount of time within any portion of the firing pulse may be suppressed. However, in examples where the firing pulse is to be trimmed or extended by a relatively large amount such as by 64 counts of the clock, the size of the resulting shift register may take up a significant portion of the fluidic die (100). In this case, a counter may be added instead.

The circuit (600) show in FIG. 7 is merely an example circuit arrangement. In some examples, additional circuitry may be included such as that shown in FIG. 5. In some examples, the circuit (700) shown in FIG. 7 may implement the regulation module and firing pulse adjustment regulator illustrated in FIG. 1.

Figure 8:
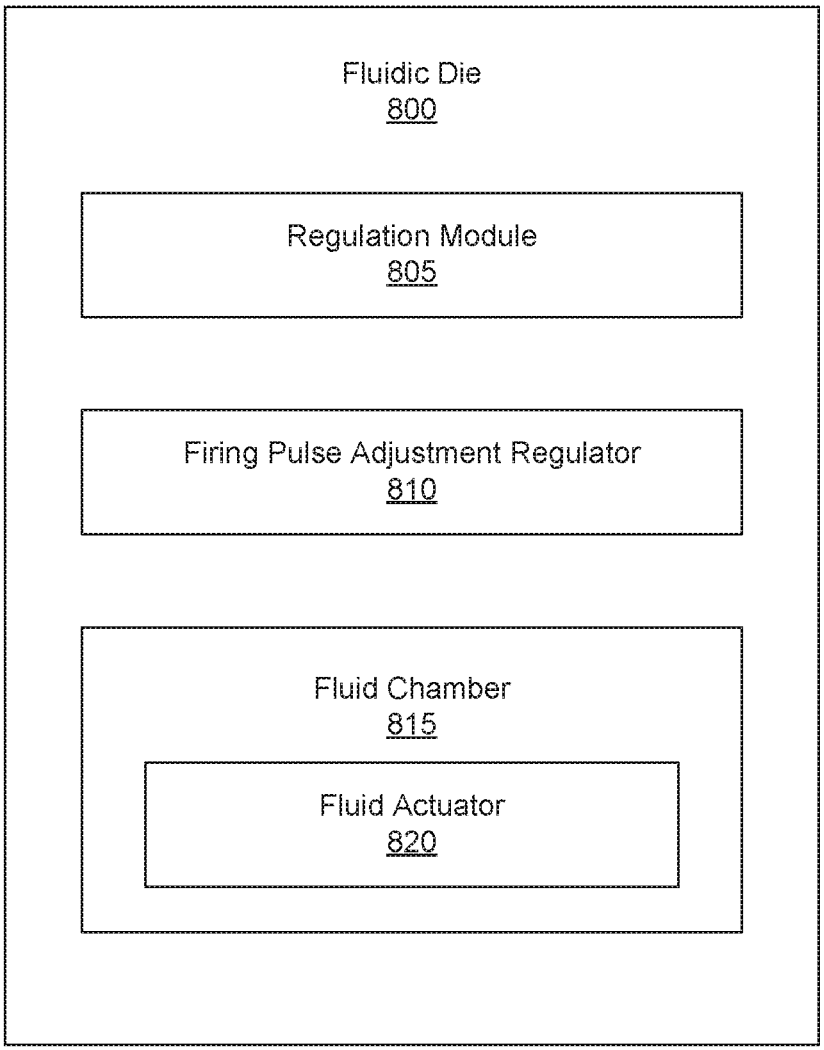
FIG. 8 is a block diagram of a fluidic die according to an example of the principles described herein.

FIG. 8 is a block diagram of a fluidic die (800) according to an example of the principles described herein. In the example shown in FIG. 8, the fluidic die (800) may include a regulation module (805) and a firing pulse adjustment regulator (810) as described herein. The fluid ejection device may further include at least one fluid chamber (815) and at least one fluid actuator (820) formed within the at least one fluid chamber (815). In an example, the fluid chamber (815) may receive an amount of fluid from a reservoir. The fluid may be any type of ejectable fluid. The fluid actuator (820) may receive the adjusted firing pulse from, for example, the fluidic die circuitry shown in and described in connection with FIGS. 1 and 3-7. The adjusted firing pulse may accommodate for the heat (or lack thereof) present in the fluidic die (800) and may be shortened or lengthened accordingly. The fluid actuator (820) may then be actuated using this adjusted firing pulse such that the fluid may be ejected from the fluidic chamber, through a nozzle, and away from the fluidic die (800).

Figure 9:
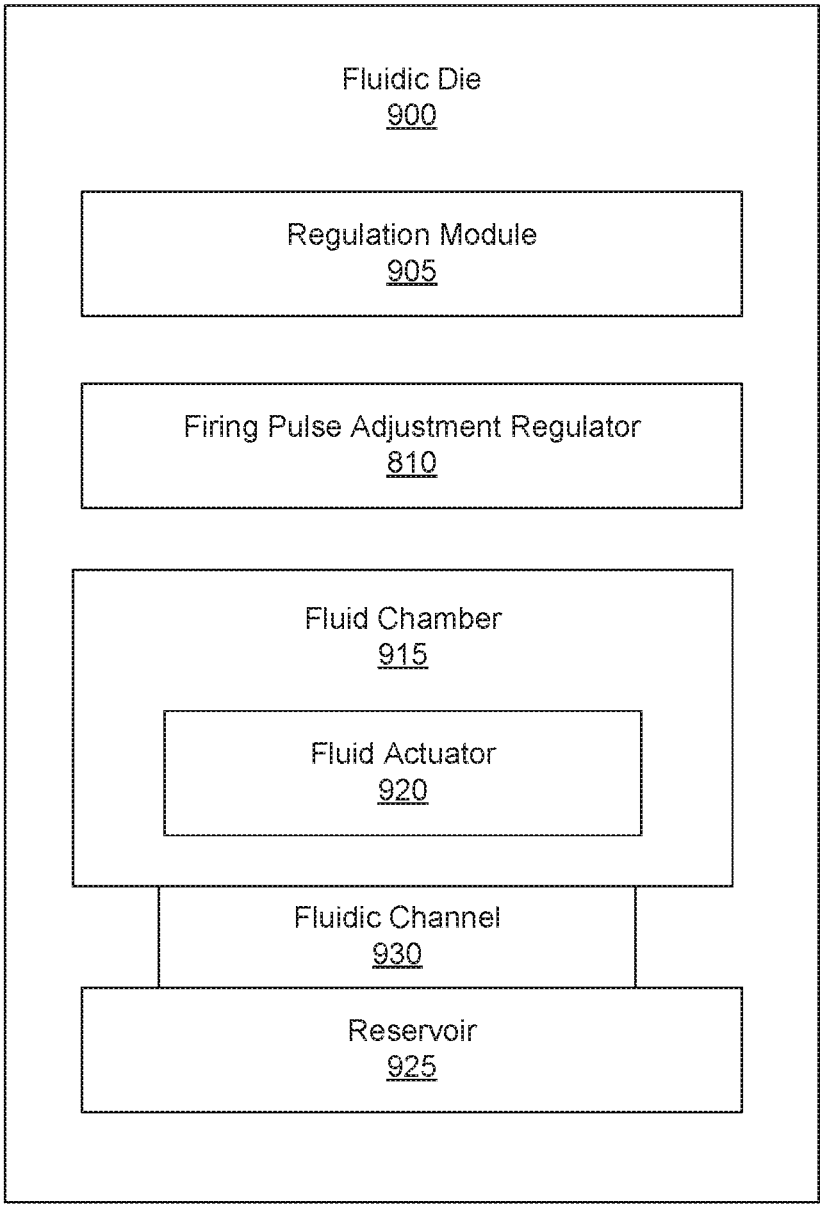
FIG. 9 is a block diagram of a fluidic die according to an example of the principles described herein.

FIG. 9 is a block diagram of a fluidic die (900) according to an example of the principles described herein. In the example shown in FIG. 9, the fluidic die (900) may include a regulation module (905) and a firing pulse adjustment regulator (910) as described herein. The fluid ejection device may further include at least one fluid chamber (915) and at least one fluid actuator (920) formed within the at least one fluid chamber (915). In an example, the fluid chamber (915) may receive an amount of fluid from a reservoir. The fluid may be provided to the fluid chamber (915) via a fluidic channel (930) fluidically coupling a reservoir (925) to the fluid chamber (915). The fluid may be any type of ejectable fluid. The fluid actuator (920) may receive the adjusted firing pulse from, for example, the fluidic die circuitry shown in and described in connection with FIGS. 1 and 3-7. The adjusted firing pulse may accommodate for the heat (or lack thereof) present in the fluidic die (900) and may be shortened or lengthened accordingly. The fluid actuator (920) may then be actuated using this adjusted firing pulse such that the fluid may be ejected from the fluidic chamber, through a nozzle, and away from the fluidic die (900).

The specification and figures describe a regulation module within a fluidic die that regulates the firing pulse sent to any number of actuators therein. The fluidic die may be partitioned into separate zones such with each zone's temperature being read. The temperature may be used to adjust the length of the firing pulse using a regulation module. The adjustment of the length of the firing pulse allows for fluid ejection even when the temperature of the fluidic die is high or low. Where the temperature of the fluidic die is high, the firing pulse may be trimmed to prevent additional heat from being introduced into the fluidic die. Where the temperature of the fluidic die is low, the firing pulse may be lengthened so as to heat up the fluidic die to a predetermined operating temperature. In this manner, the fluidic die may be maintained at or around a predetermined operating temperature thereby increasing the quality of prints produced as well as the lifespan of the fluidic die and its associated components. The circuits illustrated by the circuit diagrams presented in the present specification allow for relatively small footprints within the die while still providing for consistent temperature control within the fluidic die. Additionally, the circuits described herein provide for the fluidic die that maintains a consistent drop weight of fluid from the actuators.

The preceding description has been presented to illustrate and describe examples of the principles described. This description is not intended to be exhaustive or to limit these principles to any precise form disclosed. Many modifications and variations are possible in light of the above teaching.

What is claimed is:

1. A fluidic die, comprising:

a regulation module communicatively coupled to a clock generator to receive a clock signal; and a firing pulse adjustment regulator, communicatively coupled to the regulation module, to calculate an adjustment value based on a sensed temperature within the fluidic die in which a firing pulse is extended in response to a sensed temperature below a specified temperature and a firing pulse is trimmed in response to a sensed temperature above the specified temperature;

wherein the regulation module adjusts an input firing pulse at the fluidic die based on the adjustment value.

2. The fluidic die of claim 1, wherein the regulation module comprises a counter to receive the input adjustment value and adjust the firing pulse based on counting clock cycles of the clock signal according to the adjustment value.

3. The fluidic die of claim 2, wherein the output from the counter and the firing pulse are received at a logic gate to suppress the firing pulse until the counter has accounted for the adjustment value.

4. The fluidic die of claim 2, wherein the output from the counter and the firing pulse are received at a logic gate to extend the firing pulse until the counter has accounted for the adjustment value.

5. The fluidic die of claim 4, wherein the logic gate is an OR gate to receive as input the firing pulse and the output from the counter of the regulation module.

6. The fluidic die of claim 1, wherein the regulation module comprises a shift register to receive the input adjustment value and trim or extend the firing pulse based on the input adjustment value and the clock signal.

7. The fluidic die of claim 6, wherein the output from the shift register and the firing pulse are received at a logic gate to trim the firing pulse until the shift register has accounted for the adjustment value.

8. The fluidic die of claim 6, wherein the output from the shift register and the firing pulse are received at a logic gate to extend the firing pulse until the shift register has accounted for the adjustment value.

9. The fluidic die of claim 1, further comprising:

at least one fluid chamber to receive a fluid to be ejected from the fluidic die;

at least one fluid actuator formed within the at least one fluid chamber;

wherein the adjusted input firing pulse is provided to the at least one fluid actuator.

10. The fluidic die of claim 1, wherein:

the fluidic die is partitioned into a number of zones, each zone comprising a number of fluid actuators and a temperature sensor; and the regulation module applies a same adjusted firing pulse to all actuators in a zone based on output of the temperature sensor for that zone.

11. The fluidic die of claim 1, further comprising a look-up table mapping temperatures to firing pulse widths, the firing pulse adjustment regulator to use output from the look-up table to calculate the adjustment value.

12. A method of firing a fluidic die, comprising:

generating a clock signal with a clock generator;

receiving, at a regulation module, the generated clock signal and a firing signal; and adjusting, with a firing pulse adjustment regulator providing output to the regulation module, the firing signal at the fluidic die based on an input adjustment value that is based on a sensed temperature of the fluidic die.

13. The method of claim 12, wherein the regulation module comprises a counter and wherein the counter receives the input adjustment value and adjusts the firing signal until the input adjustment value is accounted for.

14. The method of claim 13, further comprising receiving, at a logic gate, output from the counter and the firing signal and suppressing the firing signal until the counter has counted the adjustment value.

15. The method of claim 13, further comprising receiving, at a logic gate, output from the counter and the firing signal and extending the firing signal until the counter has accounted for additional clock counts within the clock signal.

16. The method of claim 12, wherein the regulation module comprises a shift register and wherein the shift register receives the input adjustment value and adjusts the firing signal until the input adjustment value is accounted for.

17. The method of claim 16, further comprising receiving, at a logic gate, the output from the shift register and the firing pulse and trimming the firing signal until the shift register has shifted the firing pulse.

18. The method of claim 12, further comprising:

partitioning the fluidic die into a number of zones, each zone comprising a number of fluid actuators and a temperature sensor; and with the regulation module, applying a same adjustment to the firing signal to all actuators in a zone based on output of the temperature sensor for that zone.

19. A fluidic die, comprising:

a regulation module communicatively coupled to a clock generator to receive a clock signal; and a firing pulse adjustment regulator, communicatively coupled to the regulation module, to calculate an adjustment value based on a sensed temperature within the fluidic die in which a firing pulse is extended in response to a sensed temperature below a specified temperature and a firing pulse is trimmed in response to a sensed temperature above the specified temperature;

wherein the regulation module adjusts an input firing pulse at the fluidic die based on the adjustment value;

wherein the fluidic die is partitioned into a number of zones, each zone comprising a number of fluid actuators and a temperature sensor; and wherein the regulation module applies a same adjusted firing pulse to all actuators in a zone based on output of the temperature sensor for that zone.

20. The fluidic die of claim 19, further comprising:

a fluid reservoir fluidically coupled to at least one fluidic channel formed in the fluidic die;

a fluidic chamber fluidically coupled to the fluidic channel comprising at least one fluid ejection device;

wherein the fluid ejection device receives the adjusted input firing pulse.

* * * * *